US009757658B1

(12) United States Patent
Kaufmann

(10) Patent No.: US 9,757,658 B1
(45) Date of Patent: Sep. 12, 2017

(54) FAIRGROUND RIDE

(71) Applicant: simtec Systems GmbH, Braunschweig (DE)

(72) Inventor: Bernd Kaufmann, Braunschweig (DE)

(73) Assignee: SIMTECH SYSTEMS GMBH, Braunschweig (DE)

( * ) Notice: Subject to any disclaimer, the term of this patent is extended or adjusted under 35 U.S.C. 154(b) by 0 days.

(21) Appl. No.: 15/223,001

(22) Filed: Jul. 29, 2016

(30) Foreign Application Priority Data

Apr. 19, 2016 (DE) ..... 10 2016 107 239

(51) Int. Cl.
*A63G 31/16* (2006.01)
*A63G 1/00* (2006.01)
*G09B 9/00* (2006.01)

(52) U.S. Cl.
CPC ..... *A63G 31/16* (2013.01); *A63G 1/00* (2013.01)

(58) Field of Classification Search
CPC ... A63G 1/00; A63G 1/38; A63G 7/00; A63G 31/00; A63G 31/04; A63G 31/16; G09B 9/00; G09B 9/12
USPC ..... 472/3, 59–61, 130; 434/29, 30, 36, 55
See application file for complete search history.

(56) References Cited

U.S. PATENT DOCUMENTS

| | | | | |
|---|---|---|---|---|
| 6,053,576 | A * | 4/2000 | Jessee | A63G 31/16 297/232 |
| 6,095,926 | A * | 8/2000 | Hettema | A63G 7/00 104/85 |
| 6,533,670 | B1 * | 3/2003 | Drobnis | A63G 31/16 434/55 |
| 7,033,177 | B2 | 4/2006 | Kim | |
| 7,094,157 | B2 | 8/2006 | Fromyer | |
| 8,641,540 | B2 | 2/2014 | Feuer | |
| 9,084,941 | B1 * | 7/2015 | Fram | A63G 7/00 |
| 2005/0014566 | A1 | 1/2005 | Hashimoto | |

FOREIGN PATENT DOCUMENTS

| | | | |
|---|---|---|---|
| DE | 29512759 | U1 | 8/1995 |
| EP | 0667798 | B1 | 4/2000 |
| EP | 1079906 | B1 | 12/2005 |

* cited by examiner

*Primary Examiner* — Kien Nguyen
(74) *Attorney, Agent, or Firm* — Whitham, Curtis & Cook, P.C.

(57) ABSTRACT

Provided herein is a fairground ride, such as a ghost train or dark ride attraction, having a vehicle including a chassis and a passenger seat for passengers. The vehicle further includes a hexapod drive set on the chassis and a rotary table connected to the hexapod drive, whereby the passenger seat is swivel-mounted on the rotary table.

12 Claims, 4 Drawing Sheets

FAIRGROUND RIDE

CROSS REFERENCE TO RELATED APPLICATION

This application claims priority to German Patent Application No. 10 2016 107 239.7 filed Apr. 19, 2016.

FIELD OF THE INVENTION

The invention relates to a fairground ride, such as a ghost train or a dark ride attraction, having a vehicle including (a) a chassis and (b) a passenger seat. Such fairground rides are for the purpose of entertaining the passengers who sit in the passenger seat and are then driven past scenes, screens or other entertainment facilities.

BACKGROUND OF THE INVENTION

Amusement rides are a staple in theme parks, amusement parks, carnivals, fairs, family entertainment centers and the like. It is known that the passenger seat of such fairground rides may be attached to a robot so that the passenger seat can be moved in all six degrees of freedom of movement. Such a structure is very flexible, but has the disadvantage that it is generally not intrinsically safe, i.e., fail safe, and generally cannot hold more than four passengers due to the expense of fixing large loads to the robot hand. The flexibility of the robot systems means that the passenger seat can be brought into positions that put the passengers at risk. Thus, extra measures must be taken to prevent an incorrect programming of the vehicle; however, an absence of errors cannot be proved in principle. Therefore, there is always an-inherent risk in the system that passengers can be injured due to incorrect programming. Accordingly, there is a need for an improved amusement ride vehicle.

SUMMARY OF THE INVENTION

The invention is based on the task of increasing passive safety for fairground rides. The invention solves the problem with a fairground ride as described above by providing a vehicle with a hexapod drive placed on the chassis and a rotary table to which the hexapod drive is connected, whereby the passenger seat is attached on the rotary table and can be tilted.

What is advantageous about such a fairground ride is that the vehicle can bring the passenger seat into all positions according to state-of-the-art technology and which is necessary for use in the fairground ride. At the same time, the vehicle is built to be intrinsically safe, which means that even a complete failure of the drives and/or incorrect programming cannot lead to a collision, which would put the passengers in danger.

From the inherent safety achieved, it also follows that the vehicle can be easily reprogrammed. Namely, it is no longer necessary to create a new movement sequence to ascertain that a risk to passengers is ruled out in all conceivable situations.

Another advantage is that it is easy to supply the vehicle with energy. If the energy supply fails, this simply means that the passengers come to a resting position in a fairground ride in accordance with the invention. In state-of-the-art systems, it must be ensured that a failure of the power supply cannot lead to passengers being endangered. This is significantly more expensive.

The fairground ride according to the invention also has the advantage that the number of passengers per vehicle can be increased. Due to their design, a hexapod drive and a turntable can be built so that they can carry large loads. In contrast to this, it is expensive to fix large loads to the robot hand of serial robots, since this causes considerable torques in the drive axles.

In accordance with a preferred embodiment, the passenger seat is designed to accommodate more than four passengers. The vehicles of fairground rides to date, of which the passenger seat is fixed on a robot, accommodation can only be built for four passengers, since the complexity of the instruments required to apply the necessary torques is unacceptably large. A fairground ride according to the invention easily caters for the accommodation of more than four passengers, for example, seven, eight, nine, ten or even more passengers.

In preferred embodiments, the chassis is path-bound. This means that it is designed in such a way that it follows a structurally-specified path without being able to leave it. In other words, it is sufficient if the chassis always travels along the path by way of design. For example, the structurally-prescribed path is exactly one rail or a pair of rails. In other words, the chassis can be a rail vehicle. Then the chassis is designed in such a way that it can be moved along exactly one rail. Alternatively, the chassis is designed or configured in such a way that it can be moved along two rails. The at least one rail can be built so that it can carry forces and/or moments, but this is not necessary. In some embodiments, the rail or track has curvatures that cause the vehicle to move from side to side.

Alternatively, the pre-set path can be a control line, i.e., a direction stretching along the trajectory that the vehicle should take. The vehicle is then preferably designed or configured to detect its position relative to the guiding line and to move autonomously to minimize the distance from the guiding line. This has the advantage that the trajectory that the vehicle moves along is structurally specified and thus accidents due to an incorrect programming of the trajectory are ruled out. In some embodiments, the trackless systems as described in US 2013/0144468 and U.S. Pat. No. 5,473,990, herein incorporated by reference, are used.

In preferred embodiments, the vehicle has an image playback surface, which can be brought into an active position in which the image playback area is located in a field of view of the passengers sitting in the passenger seat and can be brought into an inactive position in which the image playback surface is outside the field of view. It is especially favorable if the image playback surface is curved. In particular, the image playback surface is curved in such a way that it appears to be concave from the passenger seat. "Image playback surface" means a screen or a monitor.

If the image playback surface is a screen, the vehicle will preferably have a projector which is positioned to project an image onto the screen. It is particularly preferable to position the projector for the projection of the image on the screen when it is in its active position. In this way, the passengers can be shown an image, while they are moved along a trajectory by the chassis.

In some embodiments, the vehicle moves through environments created by fixed and dynamic scenery as well as visual effects on projection screens located throughout the ride. The screens can provide the normal 2-D display, but in some embodiments, the projection screens provide for 3-D display. The passenger seats move in coordination with visual effects provided on the screens, or the fixed and dynamic scenery encountered during the course of the ride.

Sound effects and lighting, as well as other special effects, can also be provided to the passenger cabin to further enhance the ride experience.

In preferred embodiments, the fairground ride has a control device, for example a control computer, which synchronizes the movement of the vehicle, the movement of the image playback surface and the projection of the image, for example, via a suitable computer program. In this way, the movement of the vehicle can be coordinated to the image, which the passengers see. It is especially favorable if the control device also controls the hexapod drive and/or the rotary table, so that movement through a virtual space can be simulated for the passengers. For example, the control device commands the passenger seats to move in almost any direction or rotation and at any velocity, acceleration or deceleration, as well as control the vehicle chassis to stop, accelerate or decelerate (forward and backwards).

In preferred embodiments, the passenger seat has a backrest and the hexapod drive and the passenger seat are configured in such a way that the backrest can be brought into a tilt position in which the tilt angle of the backrest to the horizontal is less than 20°. In some embodiments, the tilt angle is less than 15°. In this way, the passengers can, for example, be given the impression that are being accelerated in relation to the seat.

Preferably, the passenger seat can be tilted around a passenger seat rotary axis of the hexapod drive and the rotary table can be brought into a position in which the passenger seat rotary axis holds an angle with a horizontal plane of no more than 10° or, in some embodiments, not more than 5°. In this case, the passengers can sit next to each other in horizontal rows.

The hexapod drive preferably has six telescopic drives which are attached to a platform by respective base points where the hexapod drive has a center point which is the center point of the best-fit circle of the basepoints, whereby a vertical projection of the passenger seat rotary axis has a distance from the central point on a level which corresponds to at least half, preferably at least two-thirds of the radius of the best-fit circle. In other words, the passenger seat is fixed centrally on the hexapod drive so that the passenger seat can be moved up and down by pressing the hexapod drive with a large hub. The hub may be as large 3.5 meter and is preferably larger than 1.5 meter. It is possible but not necessary that all base points lie in a circle. This circle is then the best-fit circle. If not all the base points are in a circle, the best-fit circle is the circle for which the sum of the squared distance between the circle and the base points is minimal.

It is favorable if a rotary axis of the rotary table runs through the best-fit circle. It is particularly advantageous if the rotary table rotary axis has a distance from the center point of the best-fit circle, which is less than half of the radius of the best-fit circle.

A particularly simple structure results when the rotary table rotary axis includes an angle with the level through the best-fit circle, which deviates up to 10° from the right angle.

Preferably, the hexapod drive can be brought into a position, in which the work angle between the best-fit circle and the level of the horizontal plane is at least 25°. In this way, the passenger seat can be moved upwards and downwards by a large distance.

Passive safety is very important for fairground rides. Preferably, the vehicle therefore has a minimum clearance outline, whereby all backdrops, i.e., scenes, contained within the fairground ride are arranged outside of the minimum clearance outline. Minimum clearance outline refers to the area around the vehicle that a part of the vehicle and/or passengers of the vehicle can enter. This envelope area therefore surrounds the intended space in which the vehicle can be positioned in all of the possible positions of the hexapod drive, rotary table and passenger seat. In other words, the backdrops are preferably arranged so that a collision of the passenger seat or of a passenger with a backdrop is therefore ruled out because the vehicle is not capable of a movement which could result in a collision.

Preferably, the vehicle is designed to move along a given trajectory, whereby the fairground ride has at least a first backdrop in the form of a fixed screen on a first position along the trajectory and the fairground ride has a control device which is designed to automatically move the vehicle along the trajectory and to automatically project images onto the first fixed screen, where the projecting is synchronized with the movement of the vehicle. In other words, a given movie sequence is then projected on the fixed screen if the vehicle has come to a specified position.

As an alternative or in addition, the control unit or device is set up to automatically project an image onto the image playback surface, which is part of the vehicle. It is especially favorable if the projection onto the fixed screen and projection onto the image playback surface connected to the vehicle and the movement of the image playback screen are synchronized with each other.

For example, it is then possible that the vehicle is automatically positioned before a fixed screen and a specified film sequence is shown, where the vehicle-mounted image playback screen is in its inactive position. Then, the vehicle-mounted image playback surface is brought into the active position, whereby it is possible that the showing of a film on the image playback surface is started while it is being brought into the active position. The control device in this case is designed for automatic control of the components of the fairground ride so that this procedure is performed in a predetermined sequence. A particularly impressive effect is achieved when the film projected onto the image playback surface corresponds to the image projected onto the fixed screen, so that the passengers barely notice the image playback surface being brought from the inactive position into the active position. Preferably, the passenger seat's and vehicle's movement, as well as the visual and audio effects provided throughout the ride, are interconnected to give passengers a continuous adventure.

BRIEF DESCRIPTION OF THE DRAWINGS

The foregoing and other objects, aspects and advantages will be better understood from the following detailed description of preferred embodiments of the invention with reference to the drawings, in which.

DETAILED DESCRIPTION OF THE INVENTION

Before exemplary embodiments of the present invention are described in greater detail, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Figure 1:
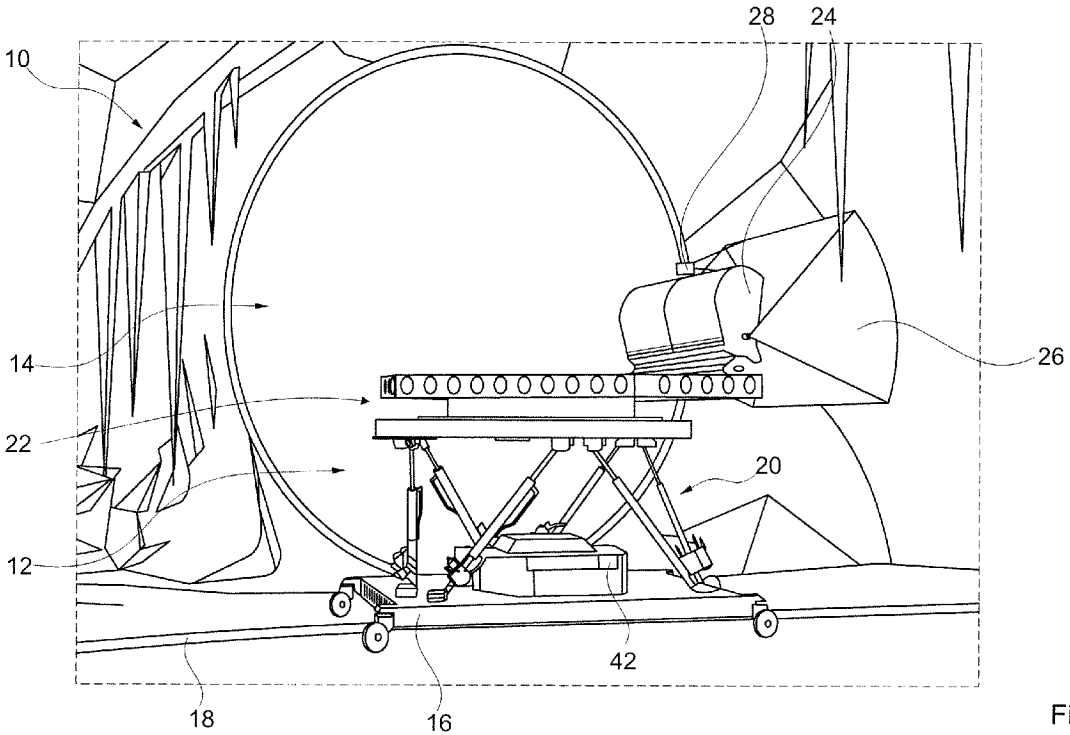
FIG. 1 is a fairground ride according to the invention in a start position.

FIG. 1 shows fairground ride 10 that has vehicle 12 and a first backdrop or scene 14 in the form of a fixed screen. Vehicle 12 has a chassis 16 designed to be self-propelled and located on rail 18. In other words, chassis 16 is designed so that it follows rail 18 without the rail 18 acting as a mechanical guide.

Alternatively, vehicle 12 can be guided by or on exactly one rail whereby the rail carries the load resulting from the driving force and any tilting moments.

Vehicle 12 has a hexapod drive 20, on which is mounted a rotary table 22. Rotary table 22 is attached to passenger seat 24, in which the passengers can sit.

Figure 3:
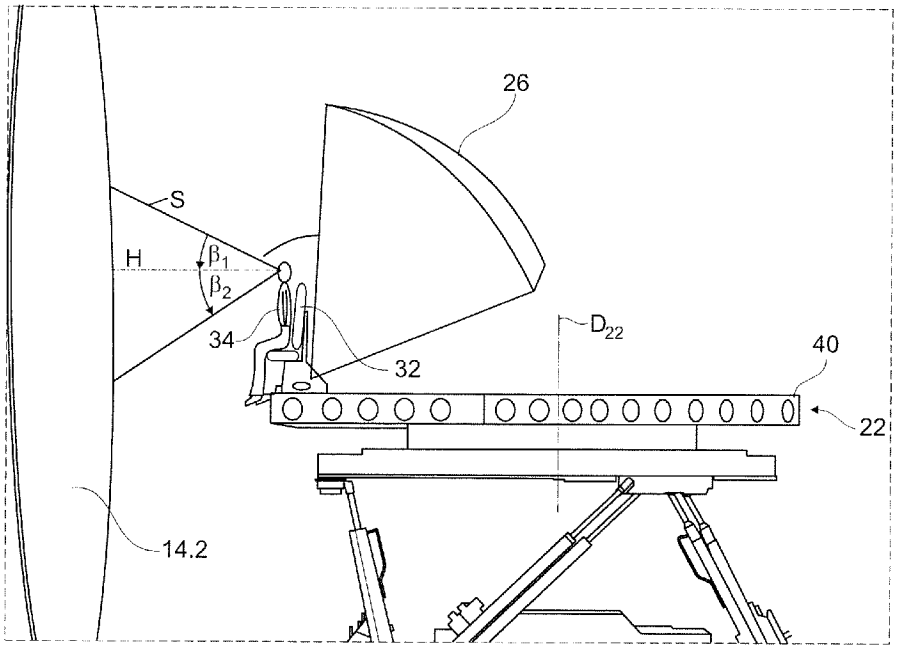
FIG. 3 is the vehicle in accordance with FIGS. 1 and 2*a-b* in which the image playback surface is in the inactive position.

FIG. 1 shows that vehicle 12 also has an image playback surface 26, which could also be generally described as a projection surface. In FIG. 1, image playback area 26 is shown in its active position in which passengers can view the image playback surface 26. FIG. 3 shows image playback surface 26 in its inactive position. In the present embodiment, image playback surface 26 is swivel-mounted relative to passenger seat 24.

In FIG. 1, projector 28 is schematically drawn by means of which an image can be projected onto image playback surface 26 which can be designed as a curved screen. Of course it is also possible that the vehicle has a screen as an alternative to or in addition to image playback surface 26.

Figures 2A, 2B:
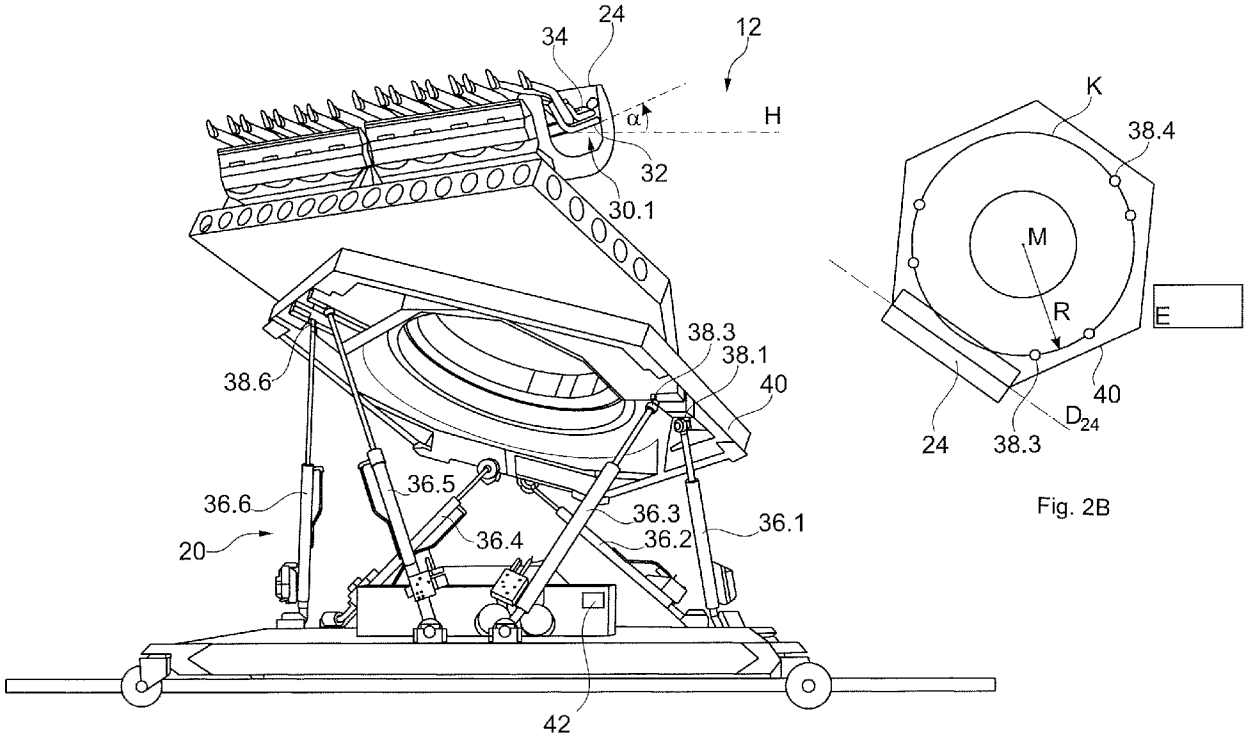
FIG. 2*a* is a fairground ride according to FIG. 1, with the vehicle in a second position.
FIG. 2*b* is a top view of the platform of the hexapod drive.

FIG. 2*a* shows vehicle 12 in a different position at which passenger seat 24 is raised. In FIG. 2*a*, image playback surface 26 is not shown. Passenger seat 24 has a plurality of seats, of which seat 30.1 is shown schematically. Seat 30.1 has a back rest 32, which forms a tilt angle $\alpha$ with the horizontal H, which is smaller than $\alpha=20°$ in the position as shown in FIG. 2*a*. A schematically-drawn passenger 34 then almost lies on his/her back.

Hexapod drive 20 has six telescopic drives of 36.1, 36.2, 36.3, 36.4, 36.5, and 36.6, which are attached by respective base points 38.*i* (i=1, 2, 3, 4, 5, 6) to platform 40. In FIG. 2*b*, platform 40 is shown schematically from above. It can be seen that base points 38.*i* are situated in best-fit circle K, which has a center point M.

Passenger seat 24 is swivel-mounted to pivot or rotate around a passenger seat rotary axis $D_{24}$. A distance of the passenger seat rotary axis $D_{24}$ from middle-point M is, in the shown embodiment, greater than radius R of the best-fit circle K. This represents a preferred embodiment of the invention.

FIG. 3 shows that rotary table 22 has a rotary table-rotary axis $D_{22}$, which, in this embodiment, runs through center point M (see FIG. 2*b*) of the best-fit circle K. The rotary table rotary axis $D_{22}$ also runs vertically to a plane through best-fit circle K. Passengers 34 can view a second scene in the form of fixed screen 14.2.

In FIG. 3, image playback surface 26 is shown in its inactive position. It is outside the field of view S of passenger 34. The field of vision shows the area of $\beta_1=60°$ above the horizontal and $\beta_2=70°$ below the horizontal. This particularly applies if the passengers are in a normal seating position. If passenger seat 24 tilts back, this angle specification does not refer to the horizontal, but to a level which has been tilted at the same angle as passenger seat 24.

Image playback surface 26 can, in the present embodiment, be tilted into the active position shown in FIG. 1 whereby the rotary axis, around which the tilting takes place, runs parallel to the passenger seat rotary axis $D_{24}$.

The following describes how a procedure according to the invention is carried out for the use of the fairground ride according to the invention. First, vehicle 12 is brought into a position in which passengers 34 can climb into passenger seat 24, in particular, passengers 34 can take a seat in passenger seat 24. Then vehicle 12 drives to a first scene 14, which could be a fixed screen. There, after vehicle 12 has arrived, an image is presented, which passengers 34 can view. Toward the end of the projected image, the image playback surface 26 turns into the field of vision of the passengers and projector 28 projects an image onto this image playback surface 26. This image can be designed in such a way that passengers 34 hardly notice the image playback surface 26 swivel.

As soon as image playback surface 26 is fully within the field of vision of the passengers, vehicle 12 moves to the next scene 14.2 (FIG. 3). In this movement, the hexapod drive, together with the rotary table, can simulate a motion, which is matched to the image which is projected onto image playback surface 26. The passengers will then have the illusion of being immersed in the scene shown in the projected image.

As soon as the vehicle has arrived before the next scene, image playback surface 26 is folded away. The second scene is a fixed screen and another image can be shown on this. The specified process steps will be executed by control device 42 which controls the components involved in fairground ride 10, in particular, the vehicle 12.

Figure 4:
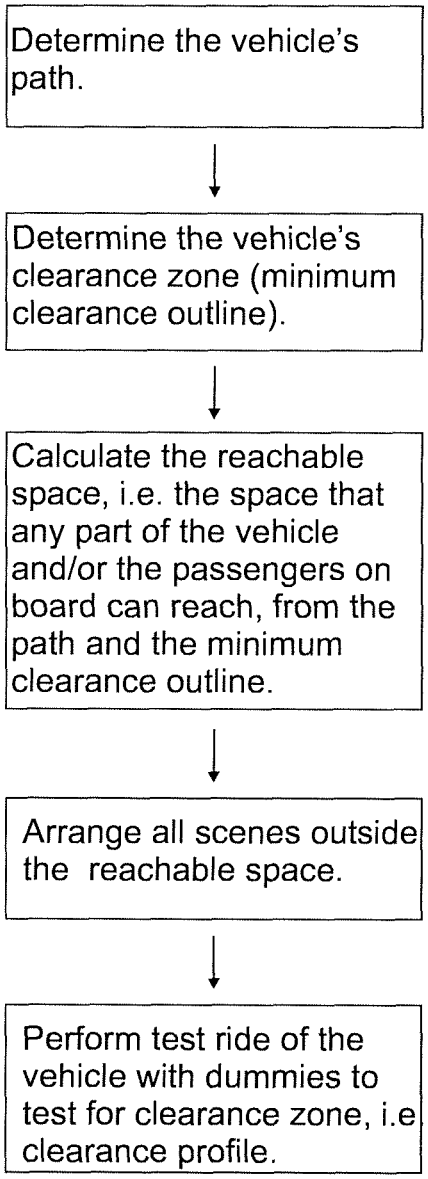
FIG. 4 is a flow chart of a method that ensures that the vehicle is not capable of a movement which could result in a collision with a scene.

FIG. 4 is a flow chart of a method that ensures that the vehicle is not capable of a movement which could result in a collision with a scene. In a first step, the path the vehicle is supposed to take is determined. The rail 18 is or will be mounted according to this path. The vehicle's clearance zone or minimum clearance outline will also be determined. This may be done by superimposing a sufficient number of outlines of the vehicle in various positions, e.g. based on the vehicle's CAD data. In a following step, the reachable space will be calculated. The reachable space is comprised of all those points that could potentially be reached by the vehicle and/or any passenger. If, for example, the vehicle's minimum clearance outline is a circle, the reachable space is hose-shaped or snake-shaped and stretches along the vehicle's path. All scenes will be arranged or placed outside the reachable space.

In order to confirm the vehicle's minimum clearance that has been found in this way, a test ride may be performed. During the test ride, at least some places of the seats of the vehicle are taken by dummies. While travelling along its path, the vehicle may perform additional movements that simulate movements that would occur in case one, two or more of the drives of the vehicle failed. In this way it can be proven that the passengers are safe even if one, two or more, e.g. all, of the drives of the vehicle fail.

While the invention has been described in terms of its preferred embodiments, those skilled in the art will recognize that the invention can be practiced with modification within the spirit and scope of the appended claims. Accordingly, the present invention should not be limited to the embodiments as described above, but should further include all modifications and equivalents thereof within the spirit and scope of the description provided herein.

The invention claimed is:

1. A fairground ride having a vehicle, wherein said vehicle comprises:

a chassis;

a passenger seat for passengers;

a hexapod drive set on the chassis; and a rotary table connected to the hexapod drive about a rotary axis;

wherein the passenger seat is swivel mounted to the rotary table such that the passenger seat can swivel about the passenger seat's pitch axis which is independent from said rotary axis.

2. The fairground ride according to claim 1, wherein the chassis is path bound.

3. The fairground ride according to claim 2, wherein the chassis is rail bound.

4. The fairground ride according to claim 1, wherein the passenger seat has a backrest, and the hexapod drive is configured to allow the backrest to be brought into a tilt position with a tilt angle of the backrest to the horizontal less than 20°.

5. The fairground ride according to claim 4, wherein the hexapod drive is configured to allow the backrest to be brought into a tilt position with a tilt angle of the backrest to the horizontal less than 15°.

6. The fairground ride according to claim 1, wherein the hexapod drive has six telescopic drives mounted on respective base points on one platform with one central point of a best-fit circle through all base points, and a vertical projection of the passenger seat rotary axis on a level through the best-fit circle is at a distance from the central point which is at least half of a radius of the best-fit circle.

7. The fairground ride according to claim 6, wherein the vertical projection of the passenger seat rotary axis on a level through the best-fit circle is at a distance from the central point which is at least two-thirds of the radius of the best-fit circle.

8. The fairground ride according to claim 1, wherein the vehicle has a minimum clearance outline, the fairground ride further comprises scenes, and all scenes are arranged outside of the minimum clearance outline.

9. The fairground ride according to claim 1, wherein the vehicle is configured to move along a given trajectory, the fairground ride at least has a first scene in the form of a fixed screen on an initial point along the trajectory, and the fairground ride has a control device configured to automatically move the vehicle along the trajectory and to automatically project images on the first fixed screen, wherein the projection is synchronised with the movement of the vehicle.

10. The fairground ride according to claim 9, wherein the trajectory follows at least one rail, so that the vehicle can move along the trajectory by moving on the rail.

11. A fairground ride having a vehicle, wherein said vehicle comprises:

a chassis;

a passenger seat for passengers;

a hexapod drive set on the chassis;

a rotary table connected to the hexapod drive, wherein the passenger seat is swivel mounted to the rotary table; and an image playback surface which can be brought into an active position in which the image playback surface is in a field of view of the passengers in the passenger seat, and can be brought into an inactive position in which the image playback surface is out of the field of view of the passengers in the passenger seat.

12. A fairground ride having a vehicle, wherein said vehicle comprises:

a chassis;

a passenger seat for passengers;

a hexapod drive set on the chassis;

a rotary table connected to the hexapod drive, wherein the passenger seat is swivel mounted to the rotary table; and an image playback surface which can be brought into an active position in which the image playback surface is in a field of view of the passengers in the passenger seat, and can be brought into an inactive position in which the image playback surface is out of the field of view of the passengers in the passenger seat, wherein the image playback surface is curved.

* * * * *